US007025016B1

(12) United States Patent
Landes

(10) Patent No.: US 7,025,016 B1
(45) Date of Patent: Apr. 11, 2006

(54) ANCHORING MARKER POST

(75) Inventor: Scott D. Landes, Bloomington, MN (US)

(73) Assignee: Rednet, Inc., Bloomington, MN (US)

( * ) Notice: Subject to any disclaimer, the term of this patent is extended or adjusted under 35 U.S.C. 154(b) by 502 days.

(21) Appl. No.: 09/710,966

(22) Filed: Nov. 14, 2000

(51) Int. Cl.
*E01F 9/011* (2006.01)
*E04H 17/22* (2006.01)

(52) U.S. Cl. ..... 116/209; 404/10; 52/154

(58) Field of Classification Search ..... 116/209, 116/63 R, 200; 404/9–11; 52/103, 153, 52/154, 155; 40/607, 612; 248/545, 156; 256/65.14, DIG. 5
See application file for complete search history.

(56) References Cited

U.S. PATENT DOCUMENTS

| | | | | | |
|---|---|---|---|---|---|
| RE13,202 | E | * | 2/1911 | Atchison | 52/154 |
| 1,089,459 | A | * | 3/1914 | Booth | 52/154 |
| 1,153,450 | A | * | 9/1915 | Schaff | 52/155 |
| 1,597,573 | A | * | 8/1926 | Blue | 40/124.5 |
| 1,886,721 | A | * | 11/1932 | O'Brien | 404/10 |
| 2,858,917 | A | * | 11/1958 | Wendt | 52/162 |
| 3,286,416 | A | * | 11/1966 | Ashworth | 52/153 |
| 3,709,112 | A | * | 1/1973 | Ebinger | 404/10 |
| 3,720,401 | A | * | 3/1973 | Loch et al. | 256/19 |
| 3,824,748 | A | * | 7/1974 | Pichowicz | 52/103 |
| 3,924,371 | A | * | 12/1975 | Kidwell | 52/161 |
| 4,078,867 | A | * | 3/1978 | Ronden | 404/10 |
| 4,084,914 | A | * | 4/1978 | Humphrey et al. | 404/10 |
| 4,106,879 | A | * | 8/1978 | Diedershagen et al. | 404/10 |
| 4,123,183 | A | * | 10/1978 | Ryan | 404/10 |
| 4,249,357 | A | * | 2/1981 | Cornou | 52/728 |
| 4,522,530 | A | * | 6/1985 | Arthur | 404/10 |
| 4,592,178 | A | * | 6/1986 | Lu | 52/155 |
| 4,625,473 | A | * | 12/1986 | Peterson et al. | 52/98 |
| 4,649,678 | A | * | 3/1987 | Lamson | 52/103 |
| 4,738,060 | A | * | 4/1988 | Marthaler et al. | 52/103 |
| 5,161,561 | A | * | 11/1992 | Jamieson | 135/16 |
| 5,494,378 | A | * | 2/1996 | Hanson | 405/244 |
| 5,832,672 | A | * | 11/1998 | Griffiths et al. | 52/4 |
| 5,870,877 | A | * | 2/1999 | Turner | 52/736.3 |
| 6,099,203 | A | * | 8/2000 | Landes | 404/10 |
| 6,113,307 | A | * | 9/2000 | Joyner, III et al. | 404/10 |
| 6,158,919 | A | * | 12/2000 | Landes | 404/9 |
| 6,461,084 | B1 | * | 10/2002 | Stuart | 405/244 |
| 6,726,184 | B1 | * | 4/2004 | Wang | 256/65.14 |

FOREIGN PATENT DOCUMENTS

| | | | | |
|---|---|---|---|---|
| EP | 0 264 915 A1 | * | 4/1988 | 404/9 |
| FR | 2 695 419 A1 | * | 3/1994 | 404/9 |
| JP | 57067817 A | * | 4/1982 | |
| JP | 57067817 A | * | 4/1982 | |

* cited by examiner

*Primary Examiner*—R. Alexander Smith
(74) *Attorney, Agent, or Firm*—Jacobson and Johnson

(57) ABSTRACT

An anchoring marker post comprising a hollow elongated member, the elongated member composed of a flexibly resilient polymer plastic and having a first end and a second end, integrally attached to the elongated member is a set of anchoring flaps, the anchoring flaps located proximate the second end of the elongated member, attaching each of the anchoring flaps to the elongated member is a flexible living hinge, the flexible living hinge allowing the anchoring flaps to be moveable from a first closed position to facilitate the handling and transportation of the marker post to a second open position to prevent the withdrawal of the elongated member from an embedded position.

10 Claims, 2 Drawing Sheets

ANCHORING MARKER POST

FIELD OF INVENTION

This invention relates generally to markers and more specifically to an anchoring marker post which when embedded in the ground provides for a resistance against the marker post being up-lifted.

BACKGROUND OF THE INVENTION

Traditionally marker posts are used to place as an above the ground warning that an underground pipe or electric line is buried in the soil. The marker post must be somewhat visually and physically unobtrusive yet be able to warn a person that an underground utility exists at the particularly marked location. In addition, the marker post must be able to withstand the environment for an extended period of time. The marker post should also be able to remain embedded at the location of the underground utility in order to continue to convey a warning message of the existence of an underground hazard to those who may be in the proximity of the underground hazard.

One problem with traditional marker posts is that once embedded, those marker posts stand a good chance of being up-lifted due to a variety of reasons such as by individuals who are in the proximity of the marker post or by nature such as due to severely windy storms.

The present invention is a resilient and weather resistant anchoring marker post which when embedded in the ground provides for resistance against the marker post being up-lifted. The anchoring marker post has at least one anchoring flap which, when embedded in the open position, uses the weight of the top soil to create resistance against the up-lifting of the post.

SUMMARY OF THE INVENTION

Briefly, the present invention comprises a hollow one piece anchoring marker post. The marker post is composed of a polymer plastic that is flexibly resilient and weather resistant. Integrally attached to the marker post is a set of anchoring flaps. The anchoring flaps are moveable from a first closed position to facilitate the handling and transportation of the marker post to a second open position to prevent the withdrawal of the marker post from an embedded position. The flap, when embedded in the open position, uses the weight of the top soil to create a resistance against the up-lifting of the post. With the flaps integrally connected to the marker post there are no additional parts to attached to the marker post thus there are fewer parts to lose.

DESCRIPTION OF THE PREFERRED EMBODIMENT

Figure 1:
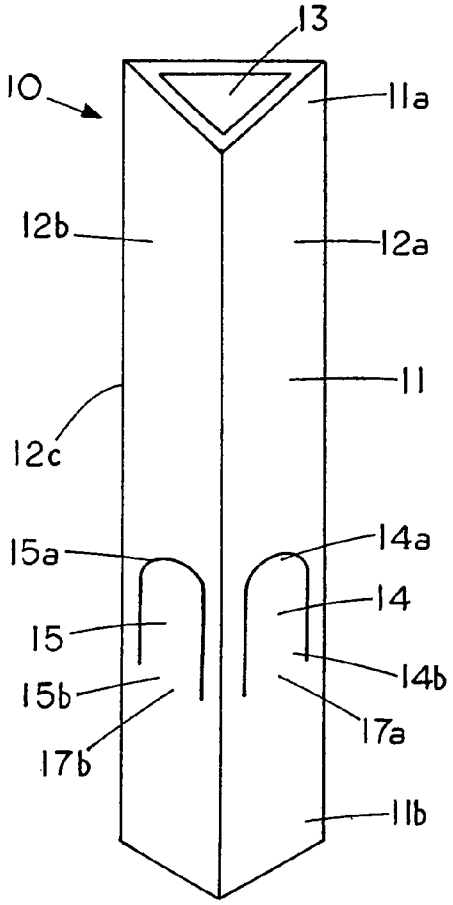
FIG. 1 is a perspective view showing the preferred embodiment of the anchoring marker post having anchoring flaps in a closed position.

Referring to FIG. 1, reference numeral 10 generally identifies an anchoring marker post of the present invention composed of a flexibly resilient plastic polymer such as polycarbonate or polyethylene. Reference numeral 11 identifies a one piece hollow triangular shaped elongated member 11 having a first end 11*a* and a second end 11*b*.

Located within elongated member 11 is a hollow interior 13. Elongated member 11 comprises a first panel 12*a*, a second panel 12*b*, and a third panel 12*c*. Located on the first panel 12*a* proximate the second end 11*b* of elongated member 11 is a first anchoring flap 14 having a first end 14*a* and a second end 14*b*. Located on the second panel 12*b* proximate the second end 11*b* of elongated member 11 is a second anchoring flap 15 having a first end 15*a* and a second end 15*b*. Located on the third panel 12*c* proximate the second end 11*b* of elongated member 11 is a third anchoring flap 16 having a first end 16*a* and a second end 16*b*.

First anchoring flap 14 is integrally connected to elongated member 11 at the second end 14*b* of anchoring flap 14 by a first living hinge 17*a*. Second anchoring flap 15 is integrally connected to elongated member 11 at the second end 15*b* of anchoring flap 15 by a second living hinge 17*b*. Third anchoring flap 16 is integrally connected to elongated member 11 at the second end 16*b* of anchoring flap 16 by a third living hinge 17*c*. The hinges are sufficiently flexible so that a user can bend the flaps out yet rigid enough to permanently anchor the post and prevent the post from being up-lifted from a top soil surface.

The advantage to the hinges being integrally connected to elongated member 11 is that there are no additional parts to fasten onto elongated member 11 which means that there are no additional parts to lose. In addition, since the anchoring flaps are integrally connected it is very unlikely that the anchoring flaps will fall off elongated member 11. As shown, the anchoring flaps of FIG. 1 are in a closed position which is defined by the anchoring flaps laying in the plane of the panel. The anchoring flaps in the close position allow for anchoring marker post 10 to be easily transferable without the flaps snagging on loose articles.

Figure 2:
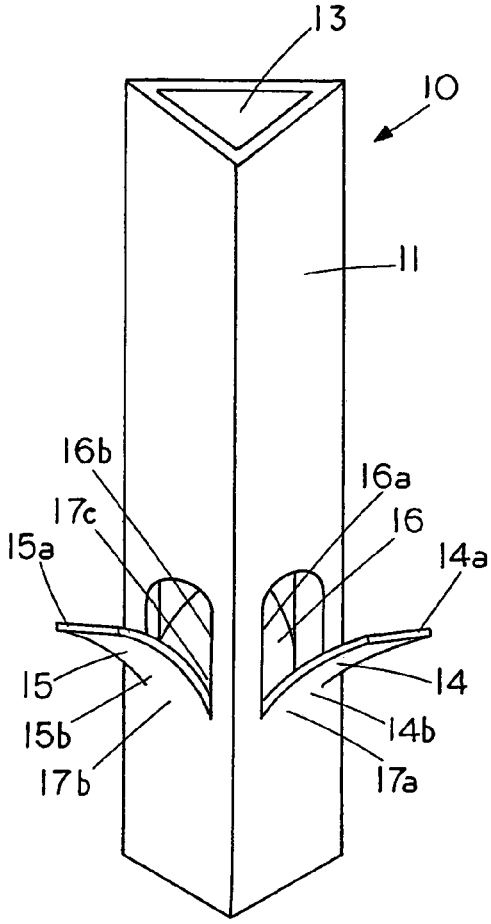
FIG. 2 is a perspective view showing the embodiment the anchoring marker post of FIG. 1 but with the anchoring flaps in an open position.

FIG. 2 shows a perspective view of the anchoring marker post of FIG. 1 but with the anchoring flaps extending to an open position. The open position is defined by the first ends 14*a*, 15*a*, 16*a* of the flaps 14, 15, 16 extending outwardly while the second ends 14*b*, 15*b*, 16*b* remain connected to the hinges 17*a*, 17*b*, 17*c*. The outward extension of the first ends of the flaps results in the bending of the flaps and hinges. The flaps of the anchoring marker post have a sufficient memory so as to not return to the closed position when bent outwardly to the open position, but instead stay in the open position until the post can be embedded. When embedded in a top soil surface, the outward extension of the first end of the flaps uses the weight of the top soil to create a resistance against the post becoming up-lifted.

Figure 3:
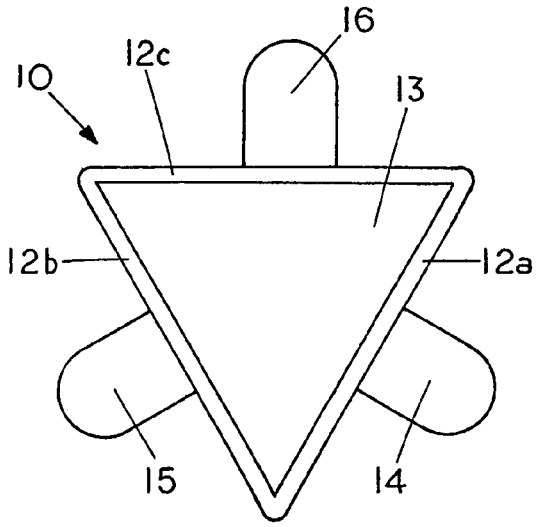
FIG. 3 is a top view showing the anchoring marker post of FIG. 2.

FIG. 3 shows a top view of the anchoring marker post 10 of FIG. 2. As is illustrated, elongated member 11 comprises first panel 12*a*, second panel 12*b*, and third panel 12*c*. The attachments of these panels form hollow interior 13. Also shown in FIG. 3 are the flaps in the open position. These flaps can vary in size and shape depending upon the type of material that will embed the marker post but for most soil anchoring flaps with a size of approximately 3 inches by 1.5 inches and with a radius of approximately 0.75 inches are sufficiently large to inhibit the withdrawal of the post.

Figure 4:
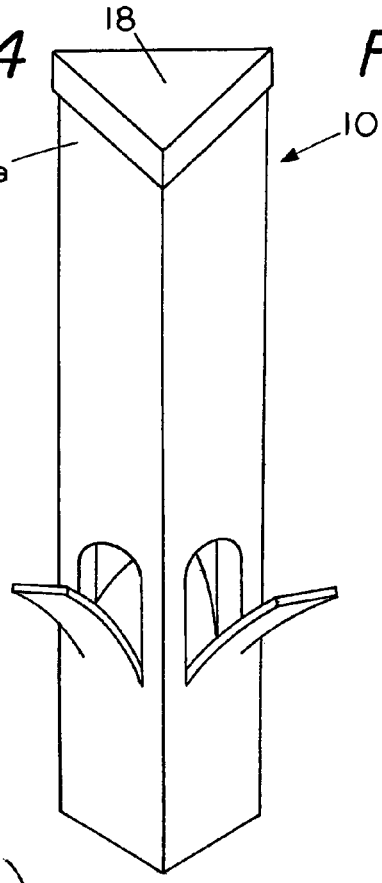
FIG. 4 is a perspective view showing the anchoring marker post of FIG. 2 with a cap thereon.

FIG. 4 shows a perspective view of the anchoring marker post 10 of FIG. 2. Attached to the first end 11*a* of elongated member 11 is a water resistant post cap 18. Post cap 18 prevents rain water, snow or debris from entering the hollow interior 13, shown in FIGS. 2 and 3, of elongated member 11.

Figure 5:
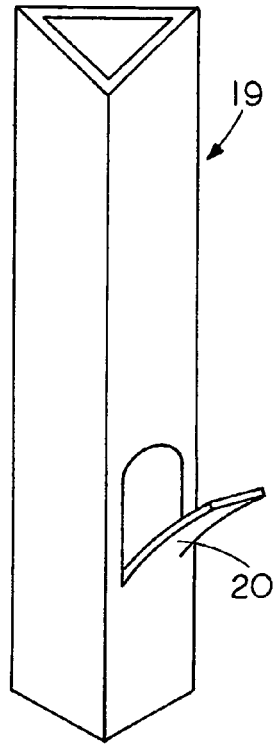
FIG. 5 is a perspective view showing a triangle shaped anchoring marker post having one anchoring flap.

FIG. 5 is a perspective view showing an anchoring marker post 19 of an alternative embodiment. Marker post 19 is similar to marker post 10 of FIG. 2 except that marker post 19 has only one anchoring flap 20 compared to marker post 10 of FIG. 2 having three anchoring flaps.

Figure 6:
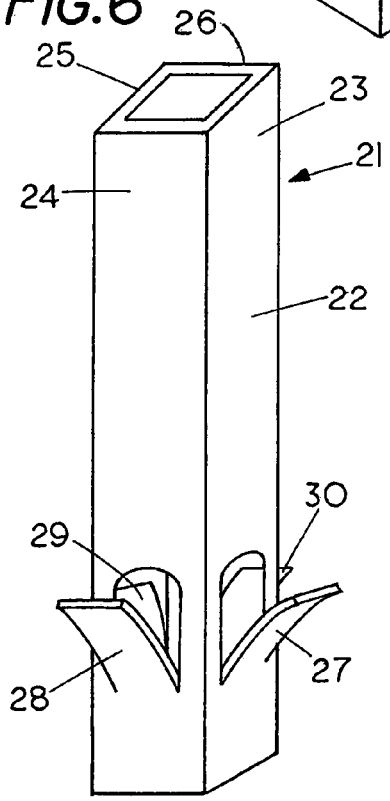
FIG. 6 is a perspective view showing an anchoring marker post having a square shaped body.

FIG. 6 is a perspective view showing an anchoring marker post 21 of an alternative embodiment having a square shape elongated member 22. Elongated member 22 is made up of a first panel 23, a second panel 24, a third panel 25, and a fourth panel 26. Attached to first panel 23 is a first integral flap 27, attached to second panel 24 is a second integral flap 28, attached to third panel 25 is a third integral flap 29 (not shown) and attached to fourth panel 26 is a fourth integral flap 30.

Figure 7:
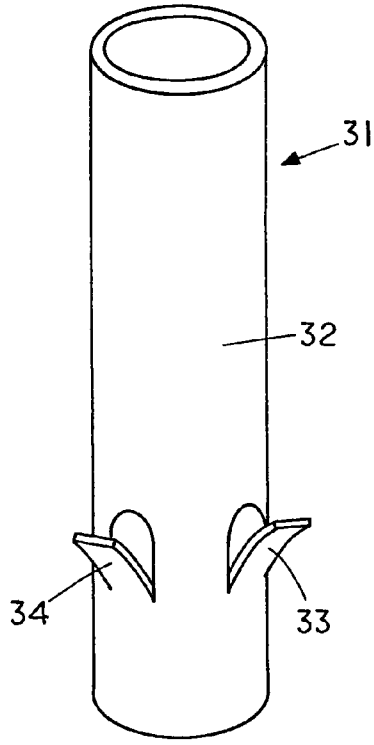
FIG. 7 is a perspective view showing an anchoring marker post having a circular shaped body.

FIG. 7 shows a perspective view of an anchoring marker post 31 having a circular shaped elongated member 32. Integrally attached to elongated member 32 are integral anchoring flaps 35 and 36 which are circumferentially positioned around elongated member 32.

In the method of making an integral anchoring marker post composed of a resilient and weather resistant polymer plastic such as polycarbonate or polyethylene one first starts off by forming a hollow post. Typically one extrudes a hollow post having a first end and a second end. The step of extruding of the hollow post is then followed by the step of forming an integral anchoring flap located proximate to the second end of the hollow post. The step of forming the integral flap can be by either the use of a stamping or a cutting device such as a punch.

In the method for transporting and embedding an anchoring marker post the steps include: (1) packaging an anchoring post having a first end and a second end and an integral anchoring flap in a closed position in a transporting container; (2) transferring the anchoring post to a desired location; (3) removing the anchoring post from the transporting container; (4) bringing the integral anchoring flap of the anchoring post to an open position from the closed position; and (5) burying the second end of the anchoring post along with the anchoring flap in the open position within a top soil surface.

I claim:

1. A marker post comprising:

a. a one-piece hollow elongated member, said one-piece hollow elongated member composed of a flexibly resilient polymer plastic, said one-piece hollow elongated member having a first end and a second end, said one-piece hollow elongated member drivable into a top layer of soil;

b. a first integral anchoring flap, said anchoring flap having a first end and a second end, said anchoring flap located proximate the second end of said one-piece hollow elongated member; and c. a first flexible living hinge, said anchoring flap attached to the one-piece hollow elongated member at the second end of said anchoring flap by said first flexible living hinge, said anchoring flap moveable from a first closed position to facilitate the handling and transportation of said marker post to a second open position to prevent the withdrawal of said one-piece hollow elongated member from an embedded position and vice versa.

2. The marker post of claim 1 including:

a. a second integral anchoring flap and a third integral anchoring flap, said second integral anchoring flap and said third integral anchoring flap each having a first end and a second end, said second integral anchoring flap and said third integral anchoring flap each located on said one-piece hollow elongated member proximate the second end of said one-piece hollow elongated member, said first integral anchoring flap and said second integral anchoring flap and said third integral anchoring flap circumferentially positioned around said one-piece hollow elongated member; and b. a second flexible living hinge and a third flexible living hinge, said second integral anchoring flap attached to the elongated member at the second end of said second integral anchoring flap by the second flexible living hinge, said third integral anchoring flap attached to the one-piece hollow elongated member at the second end of said third integral anchoring flap by the third flexible living hinge, said second integral anchoring flap and said third integral anchoring flap moveable from a first closed position to facilitate the handling and transportation of said marker post to a second open position to prevent the withdrawal of said one-piece hollow elongated member from an embedded position and vice versa.

3. The marker post of claim 1 wherein said polymer plastic is polycarbonate or polyethylene.

4. The marker post of claim 1 wherein said elongated member is triangular, circular, rectangular or square shaped and said elongated member includes a non-tapered exterior surface.

5. The marker post of claim 1 wherein said elongated member and said anchoring flap are weather resistant and said anchoring flap is in a coplanar condition with said marker post when said anchoring flap is in a closed position.

6. The marker post of claim 1 including a weather resistant cap for covering the first end of said elongated member to prevent rain or snow from entering the elongated member.

7. A hollow anchoring marker post comprising:

a. a one-piece triangular shaped elongated member having a first panel, a second panel, and a third panel forming the one-piece triangular shaped elongated member, said one-piece triangular shaped elongated member composed of a flexibly resilient polymer plastic, said one-piece triangular shaped elongated member having a first open end and a second open end, said one-piece triangular shaped elongated member drivable into a top layer of soil;

b. a first anchoring flap, a second anchoring flap, and a third anchoring flap, each of said anchoring flaps having a first end and a second end, each of said anchoring flaps integrally connected to said one-piece triangular shaped elongated member, each of said anchoring flaps located on said one-piece triangular shaped elongated member proximate the second end of said one-piece triangular shaped elongated member; and c. a first flexible living hinge, a second flexible living hinge, and a third flexible living hinge; the second end of said first anchoring flap attached to the first panel of said one-piece triangular shaped elongated member by said first flexible living hinge, the second end of said second anchoring flap attached to the second panel of said one-piece triangular shaped elongated member by said second flexible living hinge, the second end of said third anchoring flap attached to the third panel of said one-piece triangular shaped elongated member by said third flexible living hinge, each of said anchoring flaps moveable from a first closed position to facilitate the handling and transportation of said marker post to a second open position to prevent the withdrawal of said one-piece triangular shaped elongated member from an embedded position and vice versa whereby the flaps has a sufficient memory to stay in the open position until the post can be embedded.

8. The hollow one piece anchoring marker post of claim 7 wherein said polymer plastic is polycarbonate or polyethylene.

9. The marker post of claim 7 wherein said elongated member and said anchoring flaps are weather resistant.

10. The marker post of claim 7 including a weather resistant cap for covering the first end of said elongated member to prevent rain or snow from entering the elongated member.

* * * * *